United States Patent [19]

Deshich et al.

[11] 4,074,424

[45] Feb. 21, 1978

[54] CRIMPING AND WIRE LEAD INSERTION MACHINE

[75] Inventors: Dushan C. Deshich, Elmhurst; Frank P. Chmela, Downers Grove; Kenneth L. Kufner, Hickory Hills, all of Ill.

[73] Assignee: Molex Incorporated, Lisle, Ill.

[21] Appl. No.: 773,186

[22] Filed: Mar. 1, 1977

[51] Int. Cl.[2] ..... H01R 5/10

[52] U.S. Cl. ..... 29/753; 29/754

[58] Field of Search ..... 29/753, 754

[56] References Cited

U.S. PATENT DOCUMENTS

| | | | |
|---|---|---|---|
| 3,329,002 | 7/1967 | Schwalm | 29/753 |
| 3,857,154 | 12/1974 | Hammond et al. | 29/753 |

*Primary Examiner*—Lowell A. Larson
*Attorney, Agent, or Firm*—Louis A. Hecht

[57] ABSTRACT

A machine for crimping a plurality of electrical terminals one at a time onto wire leads. The machine includes a press actuable for up and down movement with a die assembly mounted thereon. The die assembly includes a die shoe with a crimp station whereat a terminal is crimped onto wire lead, a punch holder opposite and spaced from the die shoe mounted on the press for movement therewith having punch means mounted over the crimp station to engage a terminal thereat, and a terminal feed assembly for supporting and feeding a strip of terminals one at a time to the crimp station in response to the movement of the press. An insertion station is located on the die shoe adjacent and aligned with the crimp station. A housing feed assembly is on the die shoe for supporting at least one connector housing indexing the housing at the insertion station. An insertion assembly, which includes means for gripping a terminated wire lead, is provided for inserting the terminated wire lead into a terminal receiving recess formed in the housing at the insertion station.

7 Claims, 7 Drawing Figures

CRIMPING AND WIRE LEAD INSERTION MACHINE

BACKGROUND OF THE INVENTION

1. Field of the Invention

The present invention relates generally to a machine for crimping a plurality of electrical terminals one at a time onto wire leads, and, more particularly, to a crimping machine capable of inserting a terminated wire lead into a connector housing.

2. Brief Description of the Prior Art

Machines for crimping a plurality of electrical terminals one at a time onto wire leads have found wide acceptance in the electrical connector industry. A conventional crimping machine includes a press which is actuable for up and down movement and a die assembly mounted on the press. The die assembly generally includes a die shoe with a crimp station defining where a terminal is crimped onto wire lead. A punch holder is provided opposite and spaced from the crimp station mounted on the press for movement therewith and having punch means mounted over the crimp station to engage terminal thereat. Finally, a conventional crimping machine die assembly also includes a terminal feed assembly for supporting and feeding a strip of terminals one at a time to the crimp station in response to the movement of the press.

The conventional crimping machine, as described above, usually requires an operator to manually place a wire lead at the crimp station and then actuate the machine so that the terminal is crimped onto the wire lead. Subsequently, the terminated wire lead is manually inserted into a connector housing which has a plurality of terminal receiving recesses formed therein.

In order to save assembly costs, it has been found to be desirable to automatically insert a terminated wire lead into a connector housing. One machine for performing this particular function is disclosed in U.S. Pat. No. 3,964,147 which issued June 22, 1976 and is assigned to the assignee of the present invention. The subject patent discloses a machine that grasps an already terminated wire lead and inserts it into a connector housing which is indexed in the machine from terminal recess to terminal recess.

No machine efficiently performs both crimping terminals and insertion of terminated wire leads into a housing without the use of an expensive transporting system to move a terminated wire lead from a crimp station to an insertion station.

SUMMARY OF THE INVENTION

It is, therefore, the principal object of the present invention to provide an improved machine for crimping a plurality of electrical terminals one at a time onto wire leads as described above which feeds and indexes connector housings and inserts terminated wire leads into a connector housing.

The improvement comprising the invention whereby the above object is effected generally includes an insertion station on the die shoe adjacent and aligned with the crimp station, a housing feed assembly on the die shoe for supporting at least one connector housing and indexing one of the connector housing recesses at the insertion station, and an insertion assembly, including means for gripping the terminated wire lead at the crimp station, for inserting said terminated wire lead into a terminal receiving recess at the insertion station.

DESCRIPTION OF THE PREFERRED EMBODIMENT

I. INTRODUCTION

Turning now to the drawings, the crimping machine of the present invention is adapted to crimp a terminal, generally designated 10, onto a stripped insulation clad wire lead 12 (See FIG. 2) as is the purpose of conventional crimping machines. The improvement comprising the patentable feature of the present invention resides in providing means for inserting a terminated wire lead into a connector housing, generally designated 14.

Figure 7:
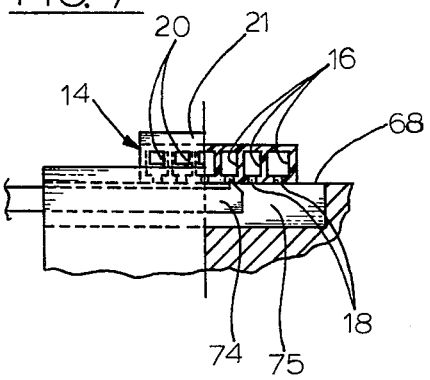
FIG. 7 is a sectional view taken generally along the lines 7—7 of FIG. 5.
Figure 2:
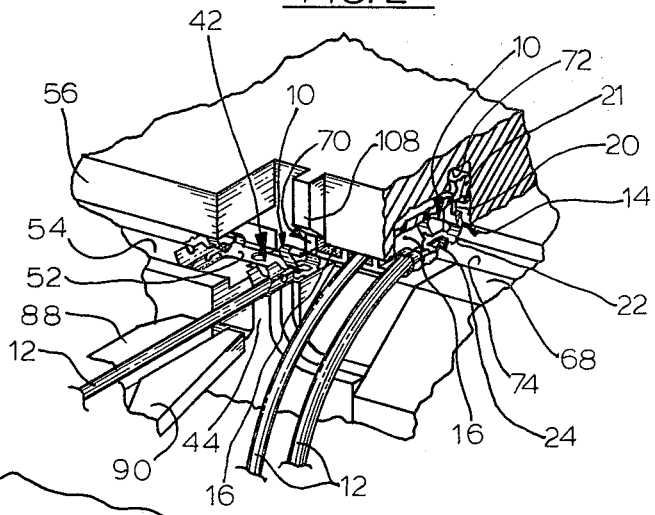
FIG. 2 is an enlarged perspective view of a portion of FIG. 1 showing the crimp station and insertion station in greater detail.

The type of housing 14 which can be used in association with the machine of the present invention is one that has a plurality of terminal receiving recesses 16. Each recess 16 has a slot 18 formed in the bottom thereof and an opening 20 formed in one end thereof (FIGS. 2 and 7). An orientation ridge 21 is formed on the top of the housing 14 for purposes which will become more apparent hereinafter.

Each terminal is of the type that may have guide tabs 22 or the like for guiding the terminal 10 into its respective recess 16. In addition, each terminal has a locking tang 24 which is adapted to engage the slot 18 in the housing to prevent accidental withdrawal thereof as best seen in FIG. 2.

The machine of the present invention generally employs the conventional features of a ordinary crimping machine but deviates in certain respects. Accordingly, those elements comprising that which make up a conventional crimping machine will be discussed first, followed by a discussion of those features which are not found in prior art crimping machines.

II. CONVENTIONAL CRIMP MACHINE

Figure 1:
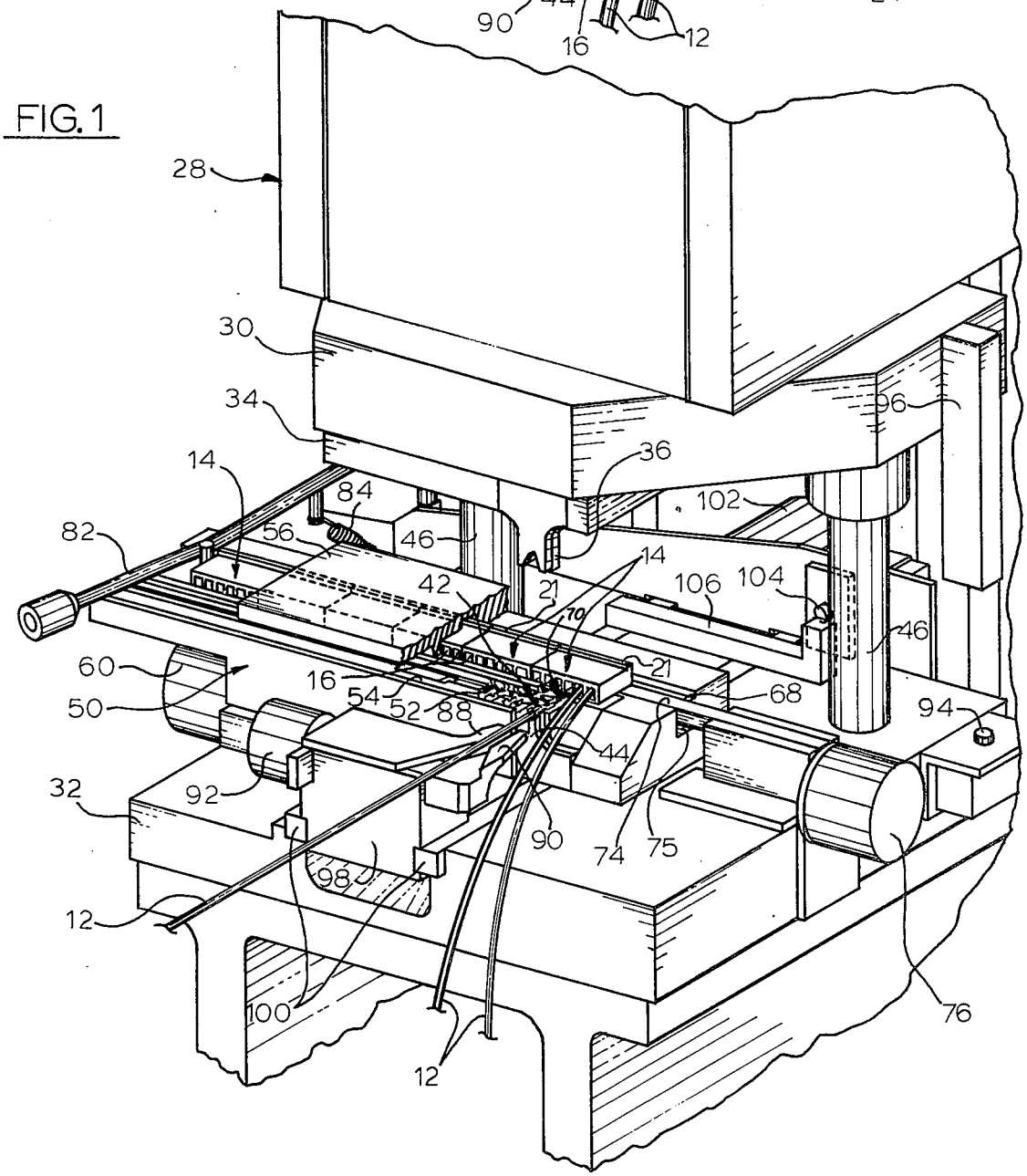
FIG. 1 is a partially fragmentary, sectioned perspective view of a portion of the machine of the present invention in a first position.

Looking at FIG. 1, the machine of the present invention is seen to generally include a press, generally designated 28, and a die assembly which is made up of a punch holder 30 mounted on the press for up and down movement therewith and a die shoe 32 spaced from the punch holder. The punch holder is seen to include a punch pad 34 which have two crimp punches 36 mounted thereon in the ordinary fashion.

A crimp station, generally designated 42, is located on the die shoe opposite the punches 36 whereat a terminal 10 is crimped onto a wire lead 12. To this end, there is provided a pair of anvils 44 which serve to crimp the terminal 10 when the punches 36 are lowered in response to the actuation of the press 28. A pair of guide posts 46 are employed to slidingly mount the press 28 and punch holder 30 for up and down movement with respect to the die shoe 32.

Looking at FIG. 1, a terminal feed assembly, generally designated 50 is mounted on the die shoe 32. The terminal feed assembly 50 serves to support and feed a strip 52 of terminals one at a time to the crimp station 42 in response to the movement of the press 28. The terminal strip 52 is received in a strip receiving channel 54 and is covered by a plate 56. A pawl member 58 (FIGS. 3–6) is mounted in the assembly 50 below the terminal strip 52 to engage a portion of the strip 52 so as to move it in response to each crimping cycle. The pawl member 58 is moved by suitable means such as an air cylinder 60 (FIG. 1).

III. HOUSING FEED ASSEMBLY

A housing feed assembly, generally designated 66 is mounted on the die shoe 32 for supporting a plurality of connector housings 14 between a surface 68 and cover plate 56 and indexing one of the terminal receiving recesses 16 at an insertion station, generally designated 70. The insertion station 70 is immediately adjacent and aligned with the crimp station 42.

The cover plate 56 has a recess 72 formed therein to receive the ridge 21 of the housings 14 therein. This serves to orient the housings 14 so that the terminal receiving recess 16 is presented correctly to the insertion station 70.

A pawl member 74 is mounted for movement beneath the surface 68 in a channel 75. The pawl member 74 is adapted to engage one of the locking slots 18 formed in the housing 14 as is best shown in FIG. 7. The pawl member 74 is moved by suitable means such as an air cylinder 76 (FIG. 1). The air cylinder 76 is actuated by switch (not shown) which is associated with the press 28.

A tapered indexing member 78 is mounted over surface 68 aligned with the insertion station 70 to be received in an opening 20 for positively positioning a housing 14 so that a given receiving recess 16 is positioned at the insertion station 70. The indexing member 78 is biased toward the housing 14 by means of a leaf spring 80 as is shown in FIGS. 3–6. The leaf spring 80 exerts a small enough force so that the indexing member 78 can pop out of the housing opening 20 the pawl member 74 pulls a housing 14 a given increment. When a new housing opening 20 is presented, the indexing member 78 will be forced by the leaf spring 80 into the next opening 20.

After a housing 14 has been completely filled with terminated wire leads, the next housing must be moved toward the insertion station 70 so that the pawl member 74 can engage the first locking slot 18 of that housing. To this end, there is provided a push rod 82 pivotly mounted on the die assembly and spring loaded by means of spring 84 to engage the last housing 14 on surface 68. The force exerted by the push rod 82 is sufficient to move the next housing 14 toward the insertion station 70.

IV. INSERTION ASSEMBLY

The machine of the present invention includes an insertion assembly, which has means for gripping a terminated wire lead, for inserting a terminated wire lead into the terminal receiving recess 16 at the insertion station 70. The gripping means generally include a stationery gripper member 88 and a second gripper member 90 movable with respect to the gripper member 88 in order to grasp a wire lead 12. Thus, the gripper member 90 is movable between an open position and a closed gripping position.

The movable gripper member 90 is moved by suitable means such as an air cylinder 92 in response to the actuation of a switch 94. The switch 94 is actuated when an actuating bar 96 mounted on the punch holder 30 strikes the switch 94 when the press 28 is brought downward during the crimping operation.

Figure 3:
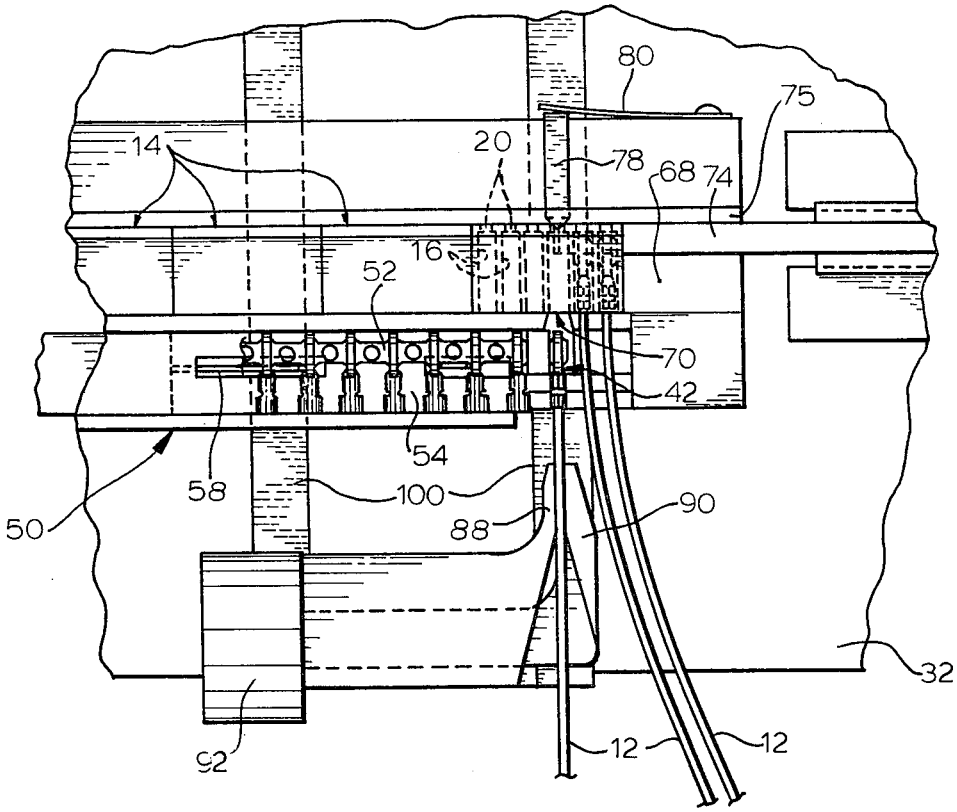
FIG. 3 is a top plan view of the housing feed assembly and the insertion assembly of the machine of the present invention in a second position.
Figure 4:
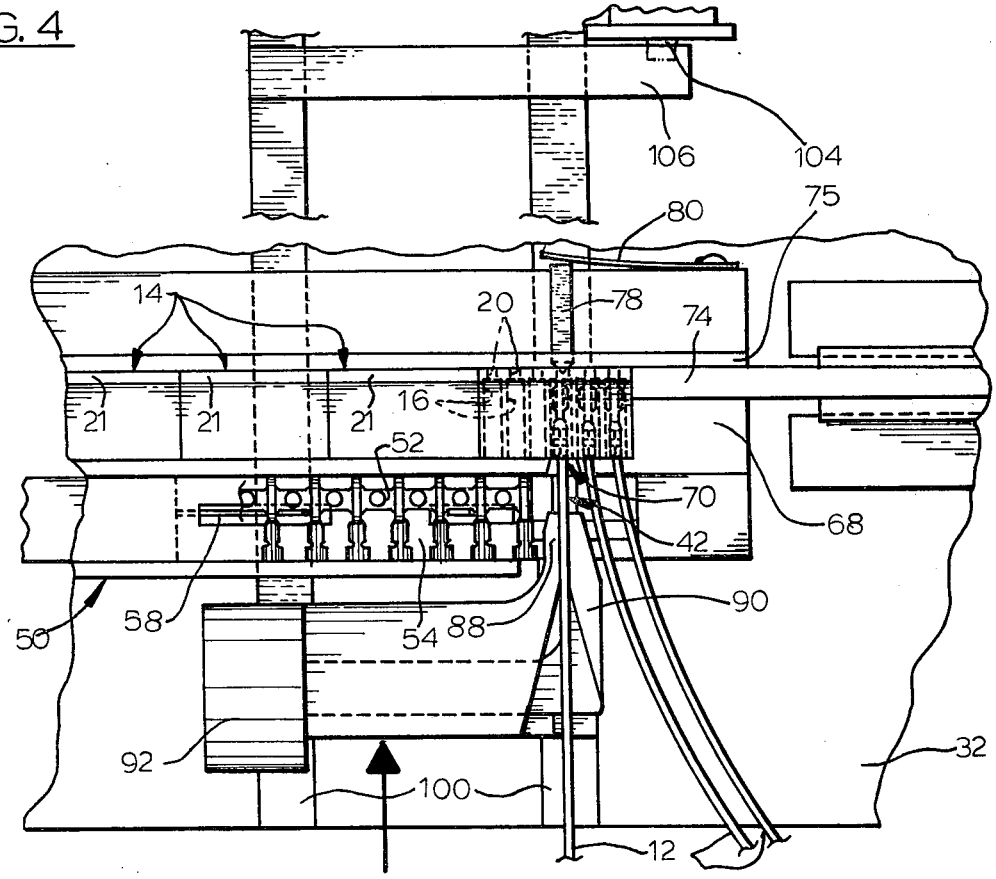
FIG. 4 is a top plan view of the housing feed assembly and insertion assembly of the machine of the present invention in a third position.
Figure 5:
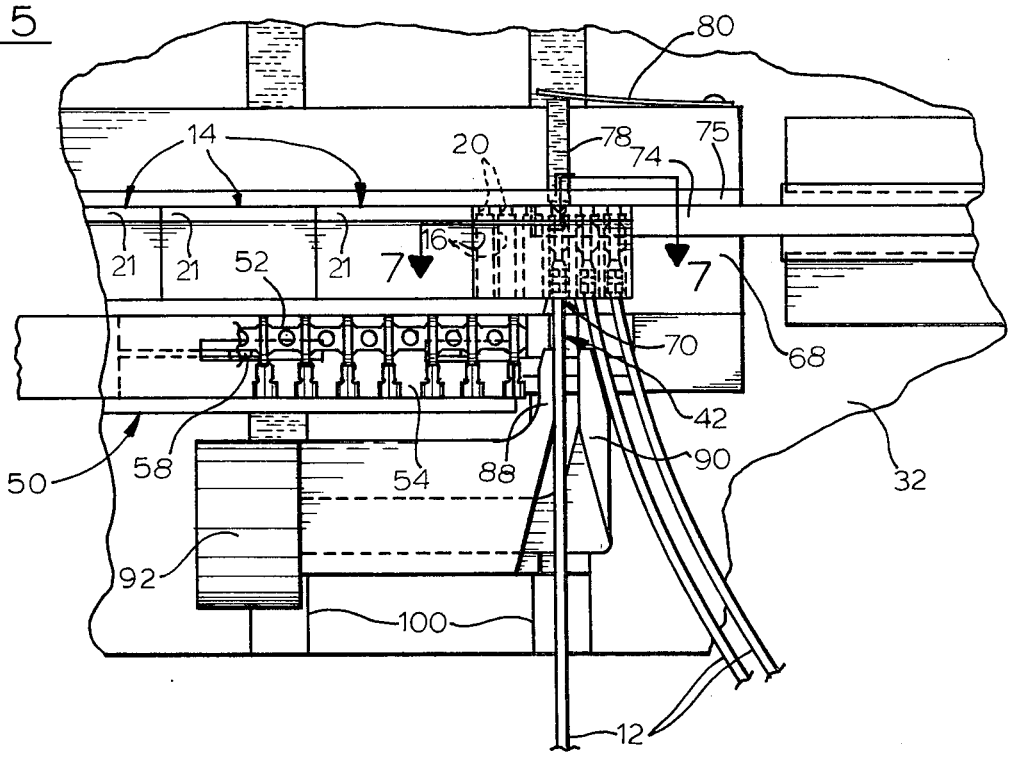
FIG. 5 is a top plan view of the housing feed assembly and insertion assembly of the machine of the present invention in a fourth position.

The gripper members 88 and 90 are mounted on a mounting block 98 which is slidingly received in a pair of opposing guide slots 100 formed in the die shoe 32. The gripper members 88 and 90 are moved with the mounting block 98 between a normal crimp position where the end of the wire lead is held over the crimp station 42 as shown in FIGS. 1–3 and 6 and an inserted position where the end of the terminated wire lead is moved forwardly to the insertion station 70 as shown in FIGS. 4 and 5 and then back to said crimp position. The mounting block 98 is moved in the above manner by means of an air cylinder 102 or other suitable means. The air cylinder 102 is actuated to move the mounting block 98 from the crimp position to the insertion position shortly after switch 94 is actuated.

After the gripper members assume their insertion position, the air cylinder 102 is actuated to move the gripper members back to its initial crimp position when switch 104 is actuated. Switch 104 is actuated by means of a bar 106 secured to the mounting block 98 for movement therewith. Thus when the bar 106 strikes switch 104 (FIG. 4) the whole insertion assembly is moved back to its original position.

A terminal guide structure 108 is formed at the insertion station 70 to aid in guiding a terminal 10 crimped on a wire lead 12 into the terminal receiving recess 16 as is best shown in FIG. 2. This offers the terminated wire lead sufficient guidance so that the movement of the grippers 88 and 90 toward the insertion station 70 will result in the necessary insertion operation.

V. OPERATION

Turning now to FIGS. 1–6, the machine of the present invention is shown in sequenced insertion operation. During the operation, a terminal 10 is crimped onto wire lead 12 and then inserted into a terminal receiving recess 16 of a connector housing 14.

In FIGS. 1 and 2, the machine of the present invention is shown in a first position. In this first position, an operator places a stripped wire lead 12 in the machine so that the end thereof is received in the uncrimped terminal 10 (FIG. 2). The gripper members 88 and 90 are open and the pawl member 74 which engages a locking slot 18 has just moved the housing 14 so that a terminal receiving recess 16 is at the insertion station 70, and the indexing member 78 is inserted into the opening 20 of the recess 16.

The operator then actuates the machine in a conventional manner such as a foot switch (not shown). This causes a double action as best shown in FIG. 3. First, the press 28 is lowered (not shown) which causes the crimping of the terminal 10 onto the wire lead 12 and causes the actuating bar 96 to strike switch 94. The actuation of the switch 94 causes the gripper member 90 to close toward gripper member 88 thereby grasping the now terminated wire lead.

The insertion assembly is then moved toward the insertion station 70 in the direction indicated by the arrow in FIG. 4. When the insertion assembly is thus moved, the terminated wire lead is inserted into the terminal receiving recess 16 located at the insertion station 70 and, at the same time, actuating bar 106 strikes the switch 104. When this occurs the terminal feed pawl member 58 is moved over prepatory to move the next terminal 10 to the crimp station 42 and the housing feed pawl member 74 is also moved to the next locking slot 18 prepatory to engagement and movement.

When switch 104 is actuated by bar 106, gripper member 90 is moved away from gripper member 88 to assume an open position immediately after the insertion of the terminated wire lead as is shown in FIG. 5. At this point the terminal feed pawl 58 engages the strip 52 prepatory to movement and the housing feed pawl 74 engages the locking slot 18 of the recess 16 adjacent the recess of the insertion station 70.

Figure 6:
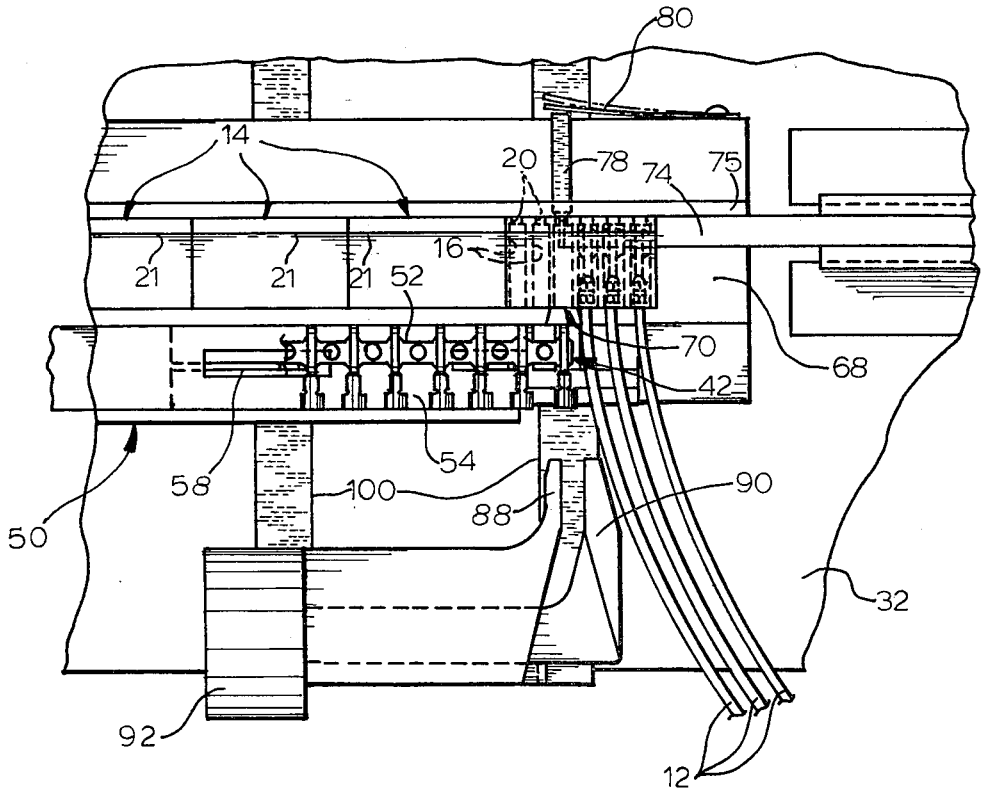
FIG. 6 is a top plan view of the housing feed assembly and insertion assembly of the machine of the present invention in a fifth position.

FIG. 6 shows the next position of the machine of the present invention wherein the pawl members 58 and 74 have been moved by the respective air cylinders 60 and 76 so that the configuration is basically the same as shown in FIGS. 1 and 2 except that a new recess has been indexed at the insertion station 70 and a new terminal 10 has been moved to the crimp station 42. The gripper members 88 and 90 have been moved back to their initial crimp position and the indexing member 78 has been forced out of one opening 20 and into the adjacent opening 20.

When the last recess 16 of a particular housing 14 has been filled with a terminated wire lead, the push rod 82 moves the adjacent housing 14 so that the housing feed pawl 74 can engage the first locking slot 18 in a manner already described.

We claim:

1. In a machine for crimping a plurality of electrical terminals one at a time onto wire leads, said machine including a press actuable for up and down movement and a die assembly mounted on said press, said die assembly including a die shoe with a crimp station whereat a terminal is crimped onto a wire lead, a punch holder opposite and spaced from said die shoe mounted on said press for movement therewith having punch means mounted over the crimp station to engage a terminal thereat, and a terminal feed assembly for supporting and feeding a strip of terminals one at a time to the crimp station in response to the movement of the press, the improvement comprising:

an insertion station on the die shoe adjacent and aligned with the crimp station;

a housing feed assembly on the die shoe for supporting at least one connector housing, said housing having a plurality of terminal receiving recesses formed therein, and indexing one of said recesses at the insertion station; and an insertion assembly, including means for gripping a terminated wire lead at the crimp station, for inserting said terminated wire lead into a terminal receiving recess at the insertion station.

2. The machine of claim 1 wherein said insertion assembly includes a pair of gripper members movable between an open position and closed gripping position in response to the downward movement of the press, said gripper members being mounted for movement in response to the press between a normal crimp position where the end of a wire lead is held over the crimp station and an inserted position where the end of the terminated wire lead is moved to the insertion station and back to said crimp position.

3. The machine of claim 2 wherein said insertion assembly includes a terminal insertion guide mounted at the insertion station between the terminal recess and the crimp station for guiding a terminal crimped onto a wire lead into the indexed terminal recess when the gripper members are moved from its crimp position to its insertion position.

4. The machine of claim 1 wherein said housing feed assembly includes pawl means cooperating with the housing for moving the housing a given increment to present a new terminal receiving recess after each insertion operation and indexing means cooperating with said housing for holding the housing during the insertion operation.

5. The machine of claim 4 wherein said housing feed assembly includes biasing means for biasing the housing in a direction that would tend to move the next recess to the insertion station.

6. In a machine for crimping a plurality of electrical terminals one at a time onto wire leads, said machine including a press actuable for up and down movement and a die assembly mounted on said press, said die assembly including a die shoe with a crimp station whereat a terminal is crimped onto a wire lead, a punch holder opposite and spaced from said die shoe mounted on said press for movement therewith having punch means mounted over the crimp station to engage a terminal thereat, and a terminal feed assembly for supporting and feeding a strip of terminals one at a time to the crimp station in response to the movement of the press, the improvement comprising:

an insertion station on the die shoe adjacent and aligned with the crimp station;

a housing feed assembly for supporting a plurality of connector housings, each housing having a plurality of terminal receiving recesses formed therein, and indexing one of said recesses at the insertion station, said housing feed assembly including pawl means cooperating with the housing for moving the housing a given increment to present a new terminal receiving recess after each insertion operation, indexing means cooperating with said housing for holding the housing during the insertion operation and biasing means for biasing the housing in a direction that would tend to move the next recess to the insertion station; and an insertion assembly including a pair of gripper members movable between an open position and closed gripping position, said gripper members being mounted for movement in response to the press between a normal crimp position where the end of a wire lead is held over the crimp station and an inserted position where the end of the terminated wire lead is moved to the insertion station and back to said crimp position.

7. The machine of claim 6 wherein said insertion assembly includes a terminal insertion guide mounted at the insertion station between the terminal recess and the crimp station for guiding a terminal crimped onto a wire lead into the indexed terminal recess when the gripper members are moved from its crimp position to its insertion position.

* * * * *